US006270179B1

(12) United States Patent
Nou

(10) Patent No.: US 6,270,179 B1
(45) Date of Patent: Aug. 7, 2001

(54) INKJET PRINTING DEVICE AND METHOD

(75) Inventor: Hiroshi Nou, Atsugi (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/199,567

(22) Filed: Nov. 25, 1998

(30) Foreign Application Priority Data

Jul. 31, 1998 (JP) ..... 10-217580

(51) Int. Cl.[7] ..... B41J 29/38
(52) U.S. Cl. ..... 347/10; 347/9; 347/11
(58) Field of Search ..... 347/9, 10, 11

(56) References Cited

U.S. PATENT DOCUMENTS 5,894,242 * 4/1999 Fujimoto ..... 347/11
5,980,015 * 11/1999 Saruta ..... 347/11
5,984,448 * 11/1999 Yanagawa ..... 347/10

FOREIGN PATENT DOCUMENTS 61-177863 * 8/1986 (JP) ..... 347/11

OTHER PUBLICATIONS

Patent Abstract of Japan No. 8–142338, dated Jun. 4, 1996.
Patent Abstract of Japan No. 7–052379, dated Feb. 28, 1995.
Patent Abstract of Japan No. 7–101051, dated Apr. 18, 1995.
Patent Abstract of Japan No. 6–218927, dated Aug. 9, 1994.
Patent Abstract of Japan No. 2–39946, dated Feb. 8, 1990.
Patent Abstract of Japan No. 5–16359, dated Jan. 26, 1993.
Patent Abstract of Japan No. 9–109390, dated Apr. 28, 1997.

* cited by examiner

*Primary Examiner*—John Barlow
*Assistant Examiner*—An H. Do
(74) *Attorney, Agent, or Firm*—Armstrong, Westerman, Hattori, McLeland & Naughton, LLP

(57) ABSTRACT

In an inkjet printing device, at least two kinds of drive waveforms are selectively fed to each of plezoelectric elements for controlling an injection amount of ink to be jetted toward a print medium via a corresponding nozzle. One of the drive waveforms is in the form of a cardiac waveform which has two voltage changing points in one drive period thereof. At the voltage changing point, a sign of slope of voltage variation is inverted. In the cardiac waveform, a voltage at one of the voltage changing points is set lower than a standby voltage, while a voltage at the other voltage changing point is set higher than the standby voltage.

57 Claims, 9 Drawing Sheets

INKJET PRINTING DEVICE AND METHOD

BACKGROUND OF THE INVENTION

1. Field of the Invention

The present invention relates to an on-demand inkjet printing device and an on-demand inkjet printing method for printing characters and/or images for use in a printer, a plotter, a facsimile device, a copying machine or the like.

2. Description of the Prior Art

An on-demand inkjet printhead includes nozzles, pressure chambers, an ink feed system, an ink tank and piezoelectric elements, and injects ink drops via the nozzles by transferring pressures generated by the piezoelectric elements to the corresponding pressure chambers so as to print characters and/or images on a print medium such as a sheet of paper.

The inkjet printing is normally a binary value printing, so that a dithering method, an error diffusion method or the like is used for realizing a halftone printing. In the dithering method, however, the number of dots for forming a unit pixel increases for increasing halftone levels. Thus, a resolution is lowered. On the other hand, in the error diffusion method, a striped pattern of dots largely degrades the quality of an image at a portion with a high brightness. It is possible to remove the foregoing drawbacks in the dithering method or the error diffusion method by enhancing the resolution, which, however, increases the cost of the device.

There is another method of realizing a halftone printing, wherein the darkness of a dot is increased by overprinting the same pixel using a binary value printer. In this event, if an injection amount of one ink drop is set equal to that required in the non-overprinting, the total ink amount per pixel becomes excessive to induce deterioration of the image quality, such as blotting of ink on a print medium. For preventing this, the injection amount of one ink drop is reduced upon overprinting while increasing the number of overprinting times. This, however, lowers the printing speed.

There is another method which realizes a halftone printing by changing amounts of ink drops injected via nozzles of an inkjet printhead. Although it is possible to achieve it by changing diameters of the nozzles of the inkjet printhead, highly precise and costly delicate processing is required for producing such an inkjet printhead.

For solving it, there has been proposed a method, wherein a drive waveform applied to each of piezoelectric elements is controlled to control a pressure in a corresponding pressure chamber so as to controllably change an amount of an ink drop injected from a corresponding nozzle.

There are roughly two methods for applying the drive waveform, i.e. voltage, to the piezoelectric element, in one of which the voltage is constantly applied to the piezoelectric element and in the other of which the voltage is applied to the piezoelectric element only upon injection of an ink drop. In the former method, the stress of the piezoelectric element against the voltage is large so that, for example, an insulation property of the piezoelectric element may be degraded. If the applied voltage is lowered for suppressing the stress, the controllability of the ink injection amount is deteriorated. Further, since the high voltage continues to be applied even in a standby state, the power consumption is also a problem.

When an analog switch is used for feeding the drive waveforms to the piezoelectric elements, such a piezoelectric element that is not used for printing over a long time can not keep a standby state since charges are lost due to discharging. Accordingly, when the printing operation is restarted, the drive waveform rises sharply due to recharging so that the ink may be unwantedly injected or the ink drop injection may become unstable.

On the other hand, for increasing the number of halftone levels, it is effective to increase the number of tone or gradation levels per dot while using the dithering method, the error diffusion method or the like. However, for achieving it, it is necessary to increase the number of drive waveforms to be fed to each of the piezoelectric elements. If a circuit structure as shown in FIG. 9 is used therefor, drive waveform feed circuits and switching elements are required as many as the number of the gradation levels of the dot. This complicates the circuit structure and increases the cost thereof.

SUMMARY OF THE INVENTION

Therefore, it is an object of the present invention to provide an improved inkjet printing device that can eliminate one or more of the disadvantages inherent in the foregoing conventional techniques.

It is another object of the present invention to provide an improved inkjet printing method that can eliminate one or more of the disadvantages inherent in the foregoing conventional techniques.

For controlling an injection amount of an ink drop, it is necessary to control a pressure in a pressure chamber and a meniscus of ink therein. Specifically, the pressure is first lowered to retreat the meniscus from the tip of a nozzle and then suddenly increased to inject an ink drop via the nozzle. A retreating magnitude of the meniscus, a pressure variation upon increasing the pressure, and a pressure increasing time reflect on injection speed and amount of an ink drop. The pressure variation can be controlled by behavior of a piezoelectric element, i.e. a drive voltage waveform applied to the piezoelectric element. As described above, there are roughly two methods for applying the voltage to the piezoelectric element. FIG. 10A shows a case of a printhead wherein a piezoelectric element is contracted when the voltage is applied so that the pressure in a pressure chamber is reduced. In this case, a drive waveform has a triangular shape as shown in FIG. 10A. On the other hand, FIG. 10B shows a case of a printhead wherein a piezoelectric element is expanded when the voltage is applied so that the pressure in a pressure chamber is increased. In this case, a drive waveform has an inverse triangular shape as shown in FIG. 10B. The present invention deals with the latter case.

According to a first aspect of the present invention, there is provided an inkjet printing device comprising a drive waveform feed device for feeding at least two kinds of drive waveforms; a deform device which deforms according to the drive waveform fed from the drive waveform feed device; and a pressure chamber which is supplied with ink and injects the ink via a nozzle by displacing a meniscus of the ink filled therein due to deformation of the deform device, wherein at least one kind of the drive waveforms fed from the drive waveform feed device has at least two changing points in one drive period thereof.

The drive waveform feed device may be in the form of a specific circuit comprising digital-analog converters etc. or may be realized by a software control so as to feed the drive waveforms. Further, the deform device may be in the form of a piezoelectric element, but is not limited thereto. Specifically, as long as it is subjected to deformation, such as expansion/contraction, shear deformation or bending deformation due to a bimorph effect, in response to applied voltage or the like, there is no particular limitation.

FIG. 1 shows an example of a drive waveform having two changing points in one drive period thereof. As appreciated, the drive waveform of the present invention having at least two changing points in one drive period thereof is not limited thereto. It may be arranged that a standby state is provided per drive period of the drive waveform and the deform device is applied with a given voltage in the standby state, and that a voltage at at least one of the changing points is set lower than the given voltage and a voltage at at least one of the changing points is set higher than the given voltage. When injecting a big ink drop, it is necessary to provide a sufficiently large amplitude of the voltage variation. Accordingly, this structure is particularly effective for injecting the big ink drop.

According to a second aspect of the present invention, there is provided an inkjet printing device comprising a drive waveform feed device for feeding at least two kinds of drive waveforms; a deform device which deforms according to the drive waveform fed from the drive waveform feed device; and a pressure chamber which is supplied with ink and injects the ink via a nozzle by varying a pressure applied to the ink filled therein due to deformation of the deform device, wherein pressure variation of the ink in the pressure chamber has at least two changing points in one drive period of the drive waveform.

The foregoing first aspect of the present invention defines the structure in terms of the displacement of the meniscus of the ink caused by the deformation of the deform device. As appreciated, when the meniscus of the ink is displaced due to the deformation of the deform device, the pressures applied to the ink filled in the pressure chamber is normally also varied. Accordingly, the second aspect of the present invention defines the structure in terms of the pressure variation applied to the ink.

It may be arranged that a standby state is provided per drive period of the drive waveform and a given pressure is applied to the ink in the pressure chamber in the standby state, and that a pressure at at least one of the changing points is set lower than the given pressure and a pressure at at least one of the changing points is set higher than the given pressure. When injecting a big ink drop, it is necessary to provide a sufficiently large amplitude of the pressure variation. Accordingly, this structure is particularly effective for injecting the big ink drop.

According to a third aspect of the present invention, there is provided an inkjet printing device comprising a drive waveform feed device for feeding at least two kinds of drive waveforms; a deform device which deforms according to the drive waveform fed from the drive waveform feed device; and a pressure chamber which is supplied with ink and injects the ink via a nozzle by varying an internal volume thereof due to deformation of the deform device, wherein internal volume variation of the pressure chamber has at least two changing points in one drive period of the drive waveform.

For the same reason applied to the foregoing second aspect of the present invention, the third aspect of the present invention defines the structure in terms of the internal volume variation of the pressure chamber.

It may be arranged that a standby state is provided per drive period of the drive waveform and the internal volume of the pressure chamber is held at a given value in the standby state, and that a volume at at least one of the changing points is set greater than the given value and a volume at at least one of the changing points is set smaller than the given value. When injecting a big ink drop, it is necessary to provide a sufficiently large amplitude of the internal volume variation of the pressure chamber. Accordingly, this structure is particularly effective for injecting the big ink drop.

According to a fourth aspect of the present invention, there is provided an inkjet printing method wherein ink is injected by displacing a meniscus of the ink in a nozzle due to a deform device which deforms according to applied one of drive waveforms, the method comprising the step of setting at least one kind of the drive waveforms to have at least two changing points in one drive period thereof.

It may be arranged that a standby state is provided per drive period of the drive waveform and a given voltage is applied in the standby state, and that a voltage at at least one of the changing points is set lower than the given voltage and a voltage at at least one of the changing points is set higher than the given voltage.

According to a fifth aspect of the present invention, there is provided an inkjet printing method wherein ink is injected by varying a pressure applied to the ink filled in a pressure chamber due to a deform device which deforms according to applied one of drive waveforms, the method comprising the step of setting pressure variation of the ink in the pressure chamber to have at least two changing points in one drive period of the drive waveform.

It may be arranged that a standby state is provided per drive period of the drive waveform and a given pressure is applied to the ink in the pressure chamber in the standby state, and that a pressure at at least one of the changing points is set lower than the given pressure and a pressure at at least one of the changing points is set higher than the given pressure.

According to a sixth aspect of the present invention, there is provided an inkjet printing method wherein ink is injected by varying an internal volume of a pressure chamber filled with the ink due to a deform device which deforms according to applied one of drive waveforms, the method comprising the step of setting internal volume variation of the pressure chamber to have at least two changing points in one drive period of the drive waveform.

It may be arranged that a standby state is provided per drive period of the drive waveform and the internal volume of the pressure chamber is held at a given value in the standby state, and that a volume at at least one of the changing points is set greater than the given value and a volume at at least one of the changing points is set smaller than the given value.

According to a seventh aspect of the present invention, there is provided an inkjet printing device comprising a drive waveform feed device for feeding drive waveforms; deform devices each of which deforms according to applied one of the drive waveforms; a switching device for choosing the deform devices to be fed with the drive waveforms according to print data; pressure chambers each of which is supplied with ink and injects the ink via a corresponding nozzle by displacing a meniscus of the ink filled therein due to deformation of the corresponding deform device; and an initializing device provided at the switching device for restoring the deform devices to a standby state per given period.

The initializing device may be in the form of a specific circuit or may be realized by a software control.

It may be arranged that the switching device comprises a multi-input-one-output analog switch for selecting one from the drive waveforms, and wherein the initializing device forcibly turns on one of analog switching elements of the analog switch.

It may be arranged that activation of the initializing device is carried out synchronously with latch pulses for the print data.

It may be arranged that the initializing device restores the deform devices to the standby state by charging them to a given voltage.

According to an eighth aspect of the present invention, there is provided an inkjet printing device comprising a drive waveform feed device for feeding drive waveforms; deform devices each of which deforms according to applied one of the drive waveforms; a switching device for choosing the deform devices to be fed with the drive waveforms according to print data; pressure chambers each of which is supplied with ink and injects the ink via a corresponding nozzle by varying a pressure applied to the ink filled therein due to deformation of the corresponding deform device; and an initializing device provided at the switching device for restoring the deform devices to a standby state per given period.

It may be arranged that the switching device comprises a multi-input-one-output analog switch for selecting one from the drive waveforms, and that the initializing device forcibly turns on one of analog switching elements of the analog switch.

It may be arranged that activation of the initializing device is carried out synchronously with latch pulses for the print data.

It may be arranged that the initializing device restores the deform devices to the standby state by charging them to a given voltage.

According to a ninth aspect of the present invention, there is provided an inkjet printing device comprising a drive waveform feed device for feeding drive waveforms; deform devices each of which deforms according to applied one of the drive waveforms; a switching device for choosing the deform devices to be fed with the drive waveforms according to print data; pressure chambers each of which is supplied with ink and injects the ink via a corresponding nozzle by varying an internal volume thereof due to deformation of the corresponding deform device; and an initializing device provided at the switching device for restoring the deform devices to a standby state per given period.

It may be arranged that the switching device comprises a multi-input-one-output analog switch for selecting one from the drive waveforms, and that the initializing device forcibly turns on one of analog switching elements of the analog switch.

It may be arranged that activation of the initializing device is carried out synchronously with latch pulses for the print data.

It may be arranged that the initializing device restores the deform devices to the standby state by charging them to a given voltage.

According to a tenth aspect of the present invention, there is provided an inkjet printing method wherein deform devices to be fed with drive waveforms are selected according to print data and ink is injected via corresponding nozzles by deforming the deform devices based on the fed drive waveforms to displace meniscuses of the ink in the nozzles, the method comprising the step of restoring the deform devices to a standby state per given period.

It may be arranged that the deform devices are restored to the standby state synchronously with latch pulses for the print data.

It may be arranged that the deform devices are restored to the standby state by charging them to a given voltage.

According to an eleventh aspect of the present invention, there is provided an inkjet printing method wherein deform devices to be fed with drive waveforms are selected according to print data and ink is injected via corresponding nozzles by deforming the deform devices based on the fed drive waveforms to vary pressures applied to the ink filled in corresponding pressure chambers, the method comprising the step of restoring the deform devices to a standby state per given period.

It may be arranged that the deform devices are restored to the standby state synchronously with latch pulses for the print data.

It may be arranged that the deform devices are restored to the standby state by charging them to a given voltage.

According to a twelfth aspect of the present invention, there is provided an inkjet printing method wherein deform devices to be fed with drive waveforms are selected according to print data and ink is injected via corresponding nozzles by deforming the deform devices based on the fed drive waveforms to vary internal volumes of corresponding pressure chambers filled with the ink, the method comprising the step of restoring the deform devices to a standby state per given period.

It may be arranged that the deform devices are restored to the standby state synchronously with latch pulses for the print data.

It may be arranged that the deform devices are restored to the standby state by charging them to a given voltage.

According to a thirteenth aspect of the present invention, there is provided an inkjet printing device comprising:

a drive waveform feed device for feeding at least two kinds of drive waveforms; deform devices each of which deforms according to applied one of the drive waveforms; a switching device for choosing the deform devices to be fed with the drive waveforms according to print data; and pressure chambers each of which is supplied with ink and injects the ink via a corresponding nozzle by displacing a meniscus of the ink filled therein due to deformation of the corresponding deform device, wherein a drive period of at least one of the drive waveforms is divided into a plurality of sub-periods each having a sub-waveform capable of injecting the ink, and wherein the switching device is capable of choosing one or a plurality of the sub-waveforms.

It may be arranged that the sub-waveforms are set to provide mutually different injection amounts of the ink.

It may be arranged that the sub-waveforms are set in order of the sub-waveforms which provide lower injection speeds of the ink.

It may be arranged that the sub-waveforms are set in order of the sub-waveforms which provide smaller injection amounts of the ink.

According to a fourteenth aspect of the present invention, there is provided an inkjet printing device comprising a drive waveform feed device for feeding drive waveforms; deform devices each of which deforms according to applied one of the drive waveforms; a switching device for choosing the deform devices to be fed with the drive waveforms according to print data; and pressure chambers each of which is supplied with ink and injects the ink via a corresponding nozzle by varying a pressure applied to the ink filled therein due to deformation of the corresponding deform device, wherein at least two kinds of pressure variations having different amplitudes are provided and a drive period of at least one of the pressure variations is divided into a plurality of sub-periods each having a sub-variation with an amplitude capable of injecting the ink, and wherein the switching device is capable of setting one or a plurality of the sub-variations.

The sub-variation represents a pressure variation corresponding to the sub-waveform recited in the thirteen aspect of the present invention.

It may be arranged that the amplitudes of the sub-variations are set so as to provide mutually different injection amounts of the ink.

It may be arranged that the sub-variations are set in order of the sub-variations which provide lower injection speeds of the ink.

It may be arranged that the sub-variations are set in order of the sub-variations which provide smaller injection amounts of the ink.

According to a fifteenth aspect of the present invention, there is provided an inkjet printing device comprising a drive waveform feed device for feeding drive waveforms; deform devices each of which deforms according to applied one of the drive waveforms; a switching device for choosing the deform devices to be fed with the drive waveforms according to print data; and pressure chambers each of which is supplied with ink and injects the ink via a corresponding nozzle by varying an internal volume thereof due to deformation of the corresponding deform device, wherein at least two kinds of internal volume variations having different amplitudes are provided and a drive period of at least one of the internal volume variations is divided into a plurality of sub-periods each having a sub-variation with an amplitude capable of injecting the ink, and wherein the switching device is capable of setting one or a plurality of the sub-variations.

The sub-variation represents an internal volume variation corresponding to the sub-waveform recited in the thirteen aspect of the present invention.

It may be arranged that the amplitudes of the sub-variations are set so as to provide mutually different injection amounts of the ink.

It may be arranged that the sub-variations are set in order of the sub-variations which provide lower injection speeds of the ink.

It may be arranged that the sub-variations are set in order of the sub-variations which provide smaller injection amounts of the ink.

According to a sixteenth aspect of the present invention, there is provided an inkjet printing method wherein deform devices to be fed with drive waveforms of at least two kinds are selected according to print data and ink is injected via corresponding nozzles by deforming the deform devices based on the fed drive waveforms to displace meniscuses of the ink in the nozzles, the method comprising the steps of dividing a drive period of at least one of the drive waveforms into a plurality of sub-periods each having a sub-waveform capable of injecting the ink; and setting one or a plurality of the sub-waveforms for the corresponding deform devices.

It may be arranged that the sub-waveforms are set to provide mutually different injection amounts of the ink.

It may be arranged that the sub-waveforms are set in order of the sub-waveforms which provide lower injection speeds of the ink.

It may be arranged that the sub-waveforms are set in order of the sub-waveforms which provide smaller injection amounts of the ink.

According to a seventeenth aspect of the present invention, there is provided an inkjet printing method wherein deform devices to be fed with drive waveforms are selected according to print data and ink is injected via corresponding nozzles by deforming the deform devices based on the fed drive waveforms to vary pressures applied to the ink filled in corresponding pressure chambers, the method comprising the steps of providing at least two kinds of pressure variations having different amplitudes; dividing a drive period of at least one of the pressure variations into a plurality of sub-periods each having a sub-variation with an amplitude capable of injecting the ink; and setting one or a plurality of the sub-variations for the corresponding pressure chambers.

It may be arranged that the amplitudes of the sub-variations are set so as to provide mutually different injection amounts of the ink.

It may be arranged that the sub-variations are set in order of the sub-variations which provide lower injection speeds of the ink.

It may be arranged that the sub-variations are set in order of the sub-variations which provide smaller injection amounts of the ink.

According to an eighteenth aspect of the present invention, there is provided an inkjet printing method wherein deform devices to be fed with drive waveforms are selected according to print data and ink is injected via corresponding nozzles by deforming the deform devices based on the fed drive waveforms to vary internal volumes of corresponding pressure chambers filled with the ink, the method comprising the steps of providing at least two kinds of internal volume variations having different amplitudes; dividing a drive period of at least one of the internal volume variations into a plurality of sub-periods each having a sub-variation with an amplitude capable of injecting the ink; and setting one or a plurality of the sub-variations for the corresponding pressure chambers.

It may be arranged that the amplitudes of the sub-variations are set so as to provide mutually different injection amounts of the ink.

It may be arranged that the sub-variations are set in order of the sub-variations which provide lower injection speeds of the ink.

It may be arranged that the sub-variations are set in order of the sub-variations which provide smaller injection amounts of the ink.

The foregoing inkjet printing devices and methods can be applied to not only inkjet printers, but also plotters, facsimile devices, copying machines or others as long as printing can be carried out on print media by injecting the ink.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings.

First Embodiment

Figure 9:
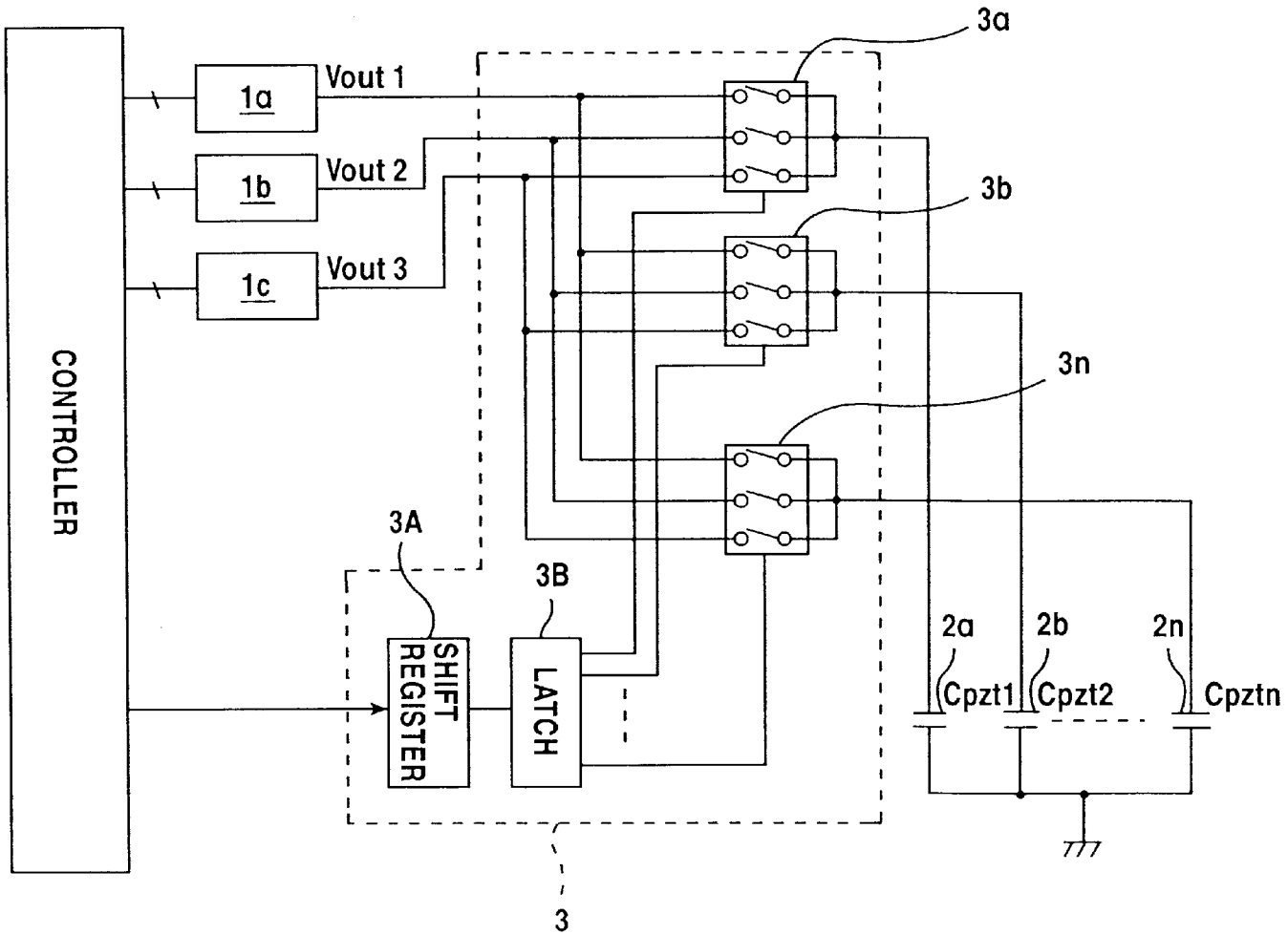
FIG.9 PRIOR ART
FIG. 9 is a diagram showing a circuit structure of a conventional multi-tone inkjet printer.
Figure 10A:
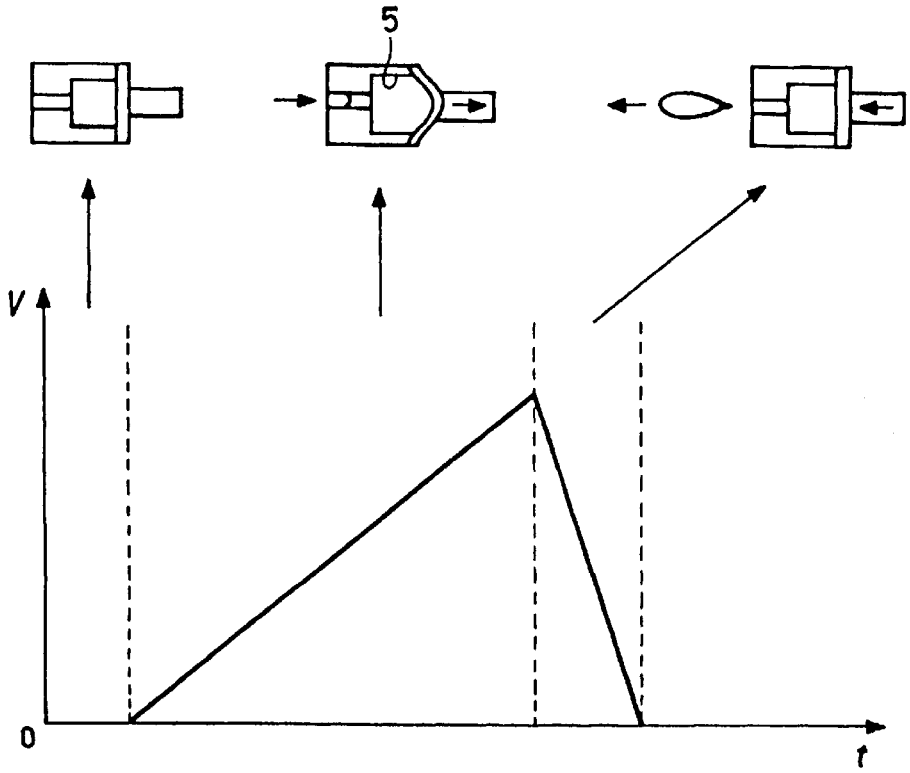
FIG.10A PRIOR ART
FIGS. 10A and 10B are diagrams each for explaining a relationship between a drive waveform and an ink injection.

FIG. 9 shows the circuit structure of a multi-tone inkjet printer. As shown in the figure, the inkjet printer comprises a drive waveform feed device including circuits 1*a*, 1*b*, 1*c* for outputting drive waveforms Vout1, Vout2, Vout3, respectively, and a deform device including piezoelectric elements 2*a*, 2*b*, . . . , 2*n* which deform (expand/contract) depending on the drive waveforms Vout1, Vout2, Vout3 applied thereto. The inkjet printer further comprises a switching device 3 including switches 3*a*, 3*b*, . . . , 3*n*, a shift register 3A and a latch 3B. According to print data fed from a controller, the switching device 3 chooses the necessary piezoelectric elements from among the piezoelectric elements 2*a*, 2*b*, . . . , 2*n* so that each of the chosen piezoelectric elements receives corresponding one of the drive waveforms Vout1, Vout2 and Vout3. The inkjet printer further comprises pressure chambers 5 (see FIGS. 10A and 10B) each for jetting an ink drop via a corresponding nozzle by displacing a meniscus of ink filled therein by means of deformation of corresponding one of the piezoelectric elements 2*a*, 2*b*, . . . , 2*n*.

Figure 10B:
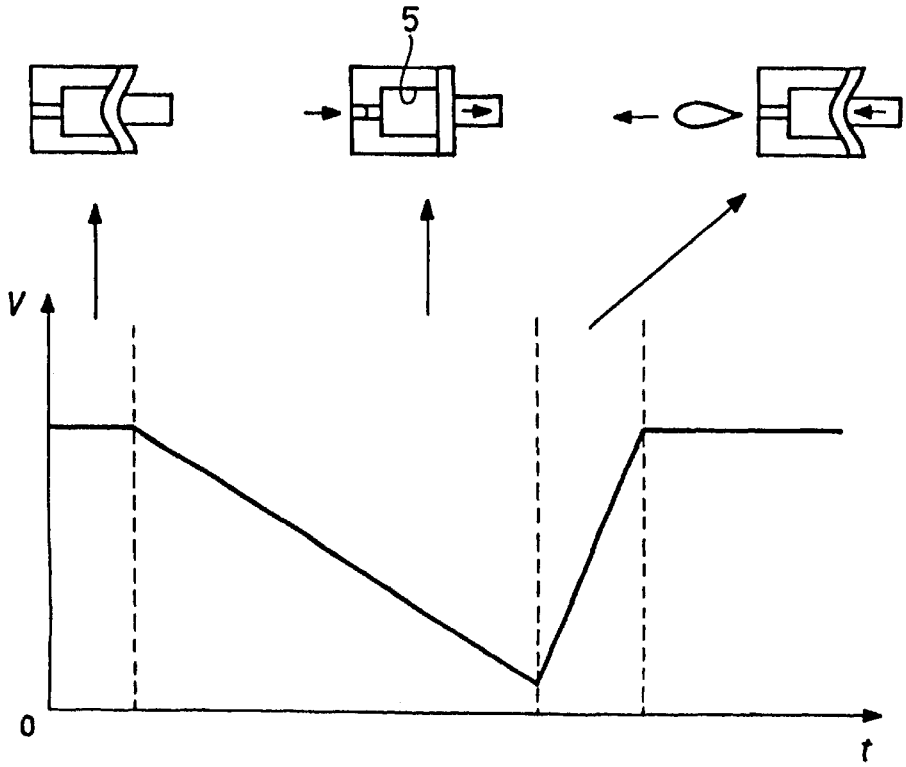
FIG10B PRIOR ART

The printhead of FIG. 10B needs to be applied with the voltage even in a standby state. Accordingly, since the voltage is applied to the piezoelectric elements over a long time, the stress of the piezoelectric elements against the voltage is high and the power consumption increases correspondingly. The voltage applied during the standby state, i.e. the standby voltage, can be lowered using a drive waveform having two or more changing points (in the specification and claims, the changing point represents a point where a voltage of the drive waveform, a pressure applied to the ink in the pressure chamber, or an internal volume of the pressure chamber changes from decreasing to increasing or from increasing to decreasing, or where a sign of slope of voltage variation, pressure variation or volume variation is inverted) in one drive period thereof as shown at (a) in FIG. 2 (the drive waveform shown at (a) in FIG. 2 will also be referred to as "cardiac waveform"). Specifically, in the prior art, the standby voltage is inevitably set high for achieving a large amplitude since the waveform is in the form of a V-shaped inverse triangular waveform wherein a voltage is sufficiently lowered from the standby voltage and then suddenly increased to the standby voltage. On the other hand, according to the cardiac waveform, an amplitude greater than the standby voltage can be obtained upon injection of the ink, the standby voltage can be set lower than the maximum voltage (higher changing point voltage) of the drive waveform. The cardiac voltage is suitable for injecting a big ink drop.

Figure 3A:
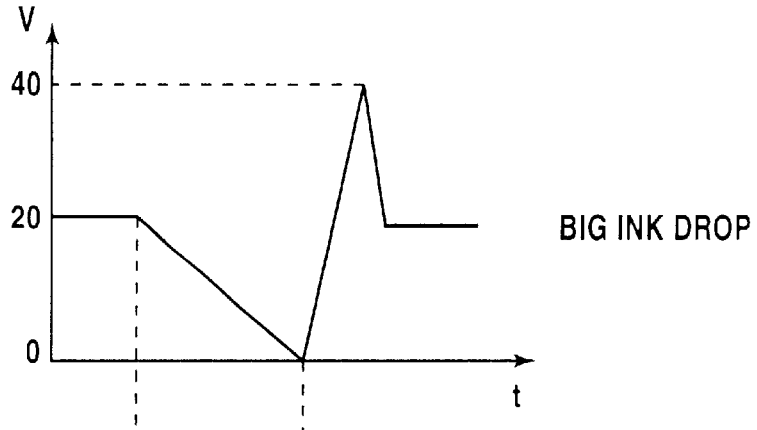
FIG. 3 is a diagram showing an example of drive waveforms according to a preferred embodiment of the present invention.
Figure 3B:
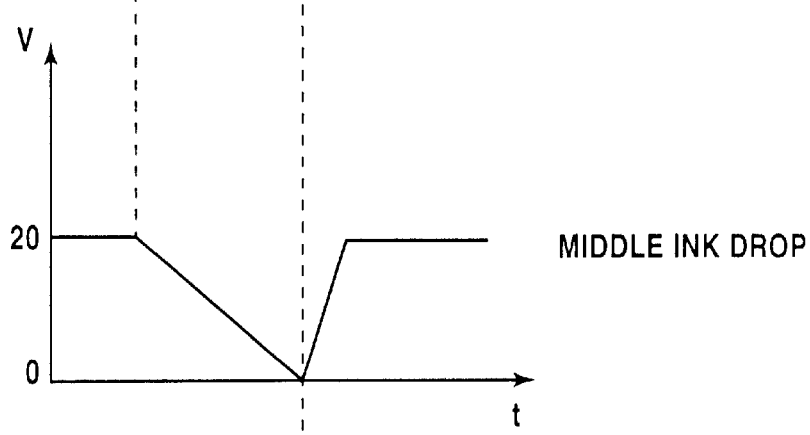
Figure 3C:
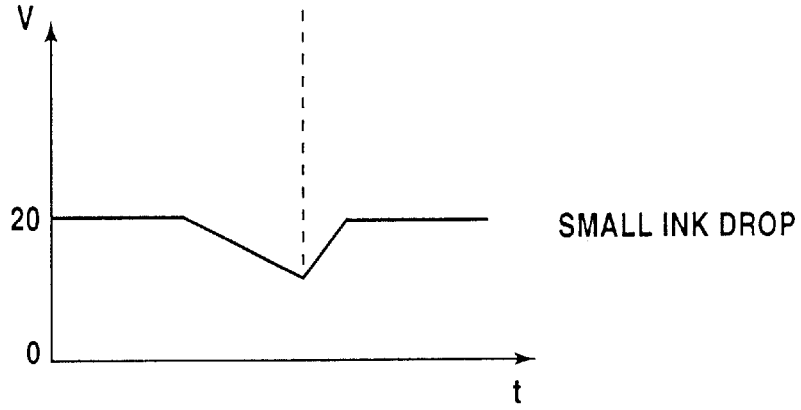

For example, when performing a gradation control of four gradations (0, 1/3, 2/3, 3/3), it is preferable that a cardiac waveform is used for a big ink drop, and triangular waveforms are used for middle and small ink drops as shown at (a), (b) and (c) in FIG. 3. In the figure, flat portions with no voltage change represent the standby states. Since the switches 3*a*, 3*b*, . . . , 3*n* connected to the piezoelectric elements 2*a*, 2*b*, . . . , 2*n* carry out required switching operations in the standby states, it is preferable to set the standby voltages of the respective drive waveforms to the same value, such as 20V as shown in FIG. 3.

Second Embodiment

Figure 1:
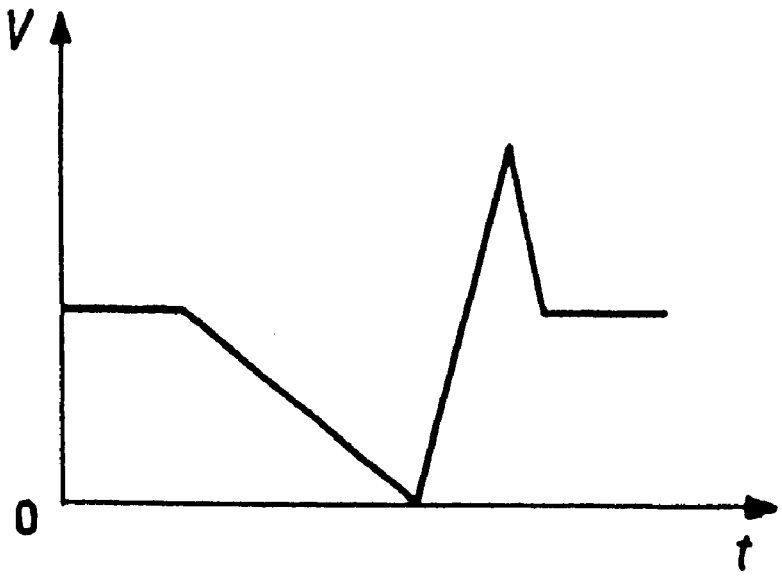
FIG. 1 is a diagram showing an example of a cardiac waveform according to a preferred embodiment of the present invention.
Figure 2A:
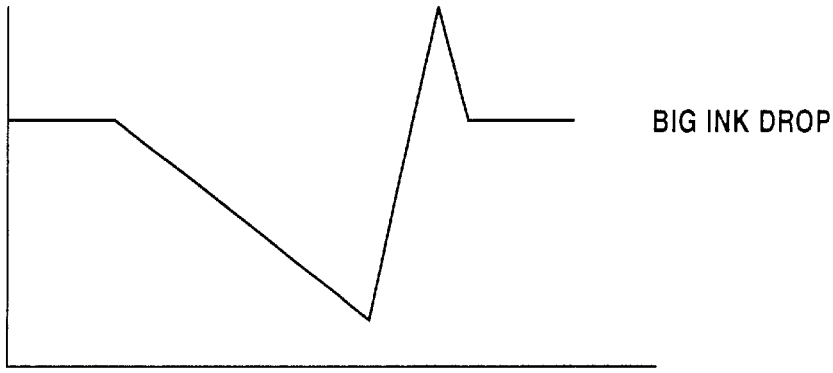
FIG. 2 is a diagram showing an example of drive waveforms according to a preferred embodiment of the present invention.
Figure 2B:
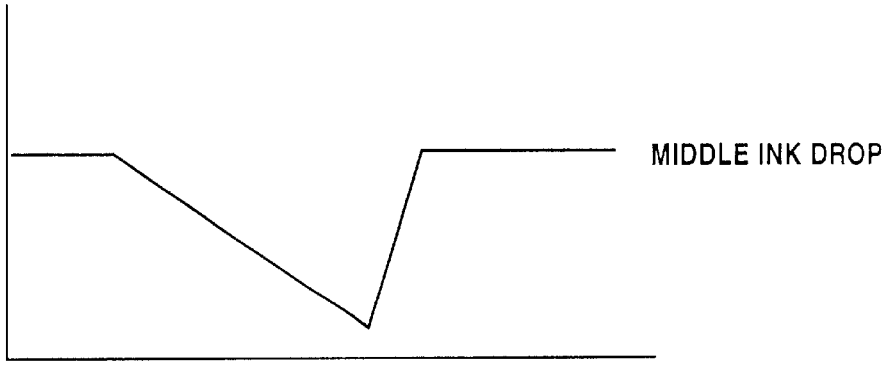
Figure 2C:
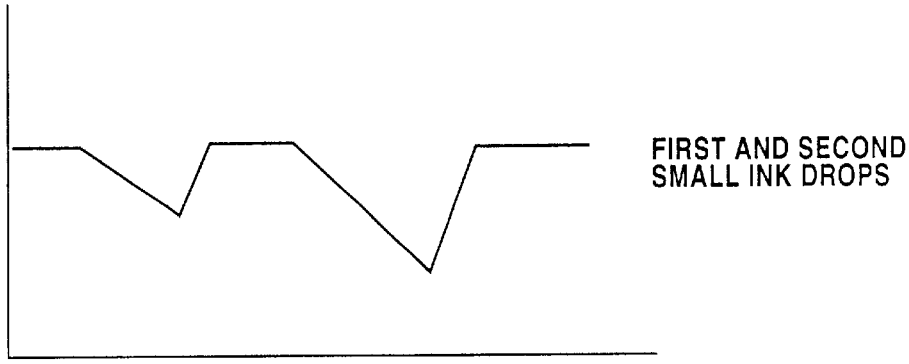
Figure 4A:
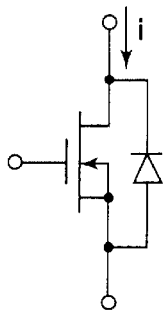
FIGS. 4A and 4B are diagrams showing switching elements in the form of a field-effect transistor and an analog switching element, respectively.
Figure 4B:
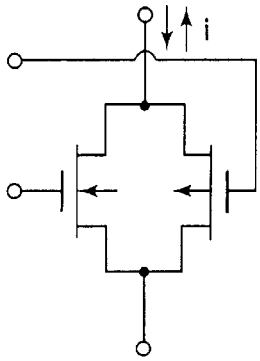

In case of the cardiac waveform shown at (a) in FIG. 2, it is necessary to keep a voltage across each of the corresponding piezoelectric elements at an intermediate level in the standby state. As shown in FIG. 4A, a field-effect transistor has been used as a switching element of each of the switches in the conventional circuit structure. Since the field-effect transistor normally has a reverse-direction parasitic diode, only the forward-direction current can be interrupted. Thus, in case of the cardiac waveform, the piezoelectric element is charged up to a peak voltage and held thereat. Accordingly, it is necessary to use an analog switching element as shown in FIG. 4B instead of the field-effect transistor.

Figure 5:
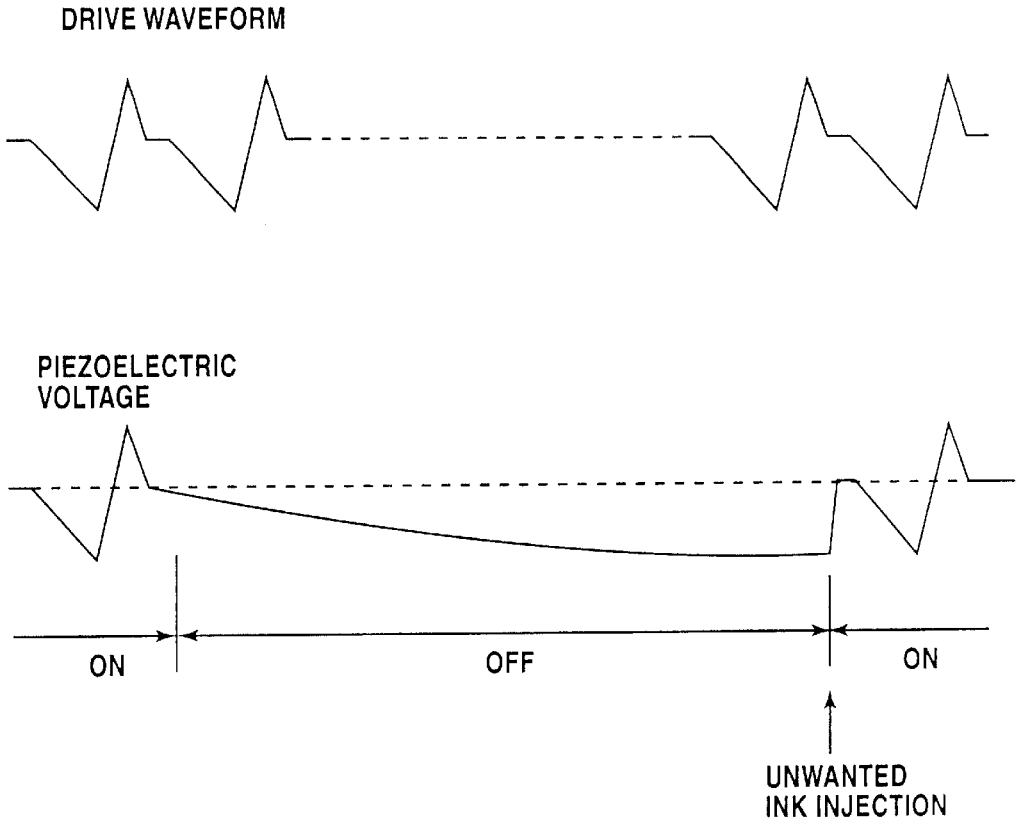
FIG. 5 is a time chart for explaining an occurrence of an unwanted ink injection.

However, when the analog switching element is used, the voltage across the piezoelectric element not used over a long time is lowered due to leakage current as shown in FIG. 5. This also applies to a case wherein only the normal drive waveform other than the cardiac waveform is fed to the piezoelectric element as long as the analog switching element is used. In this case, immediately upon turning-on of the analog switching element in the next ink injection cycle, the voltage is suddenly applied so that the piezoelectric element starts charging and an unwanted ink injection may occur.

Figure 6:
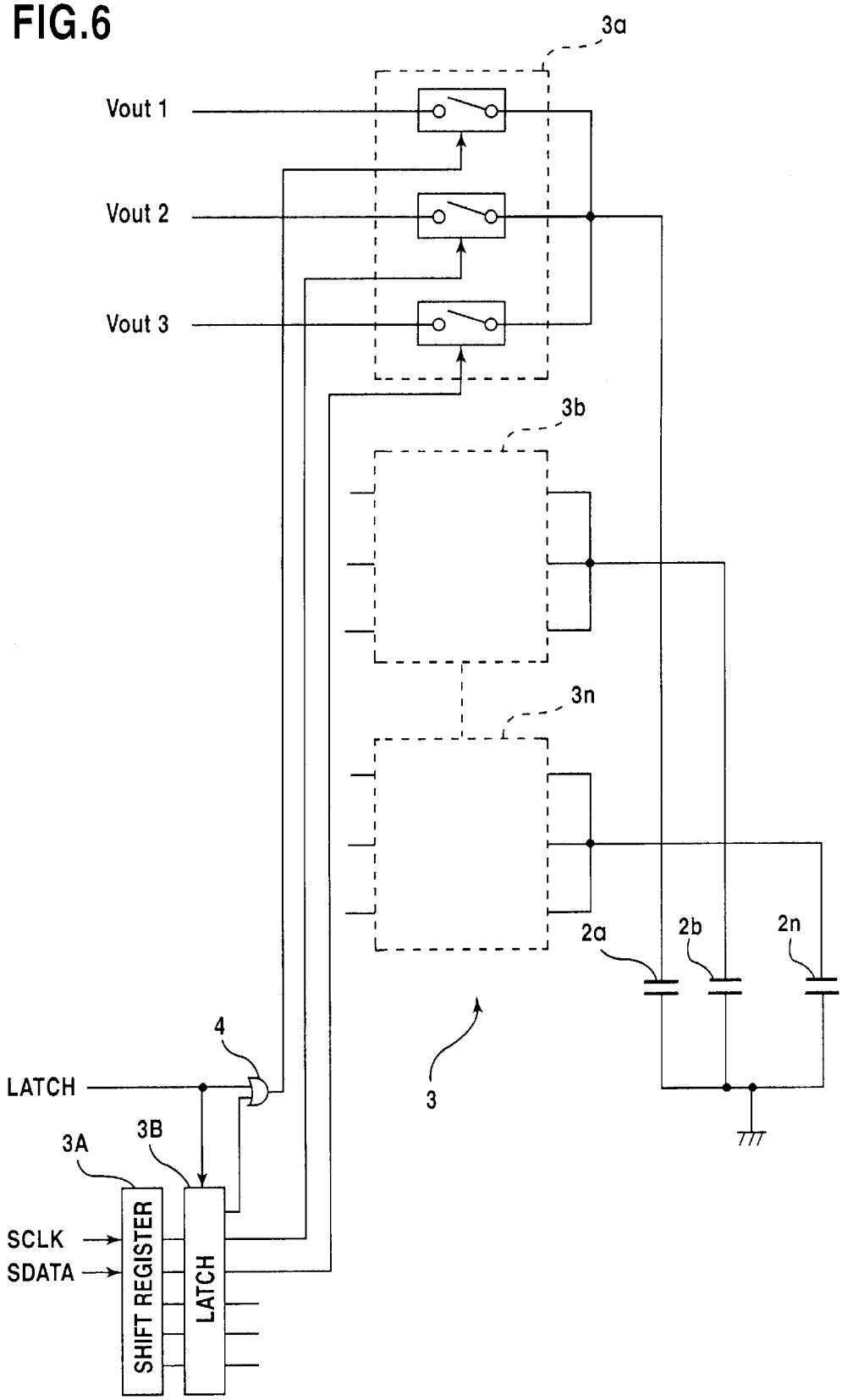
FIG. 6 is a diagram showing a circuit structure wherein a recharging function is added according to a preferred embodiment of the present invention.
Figure 7:
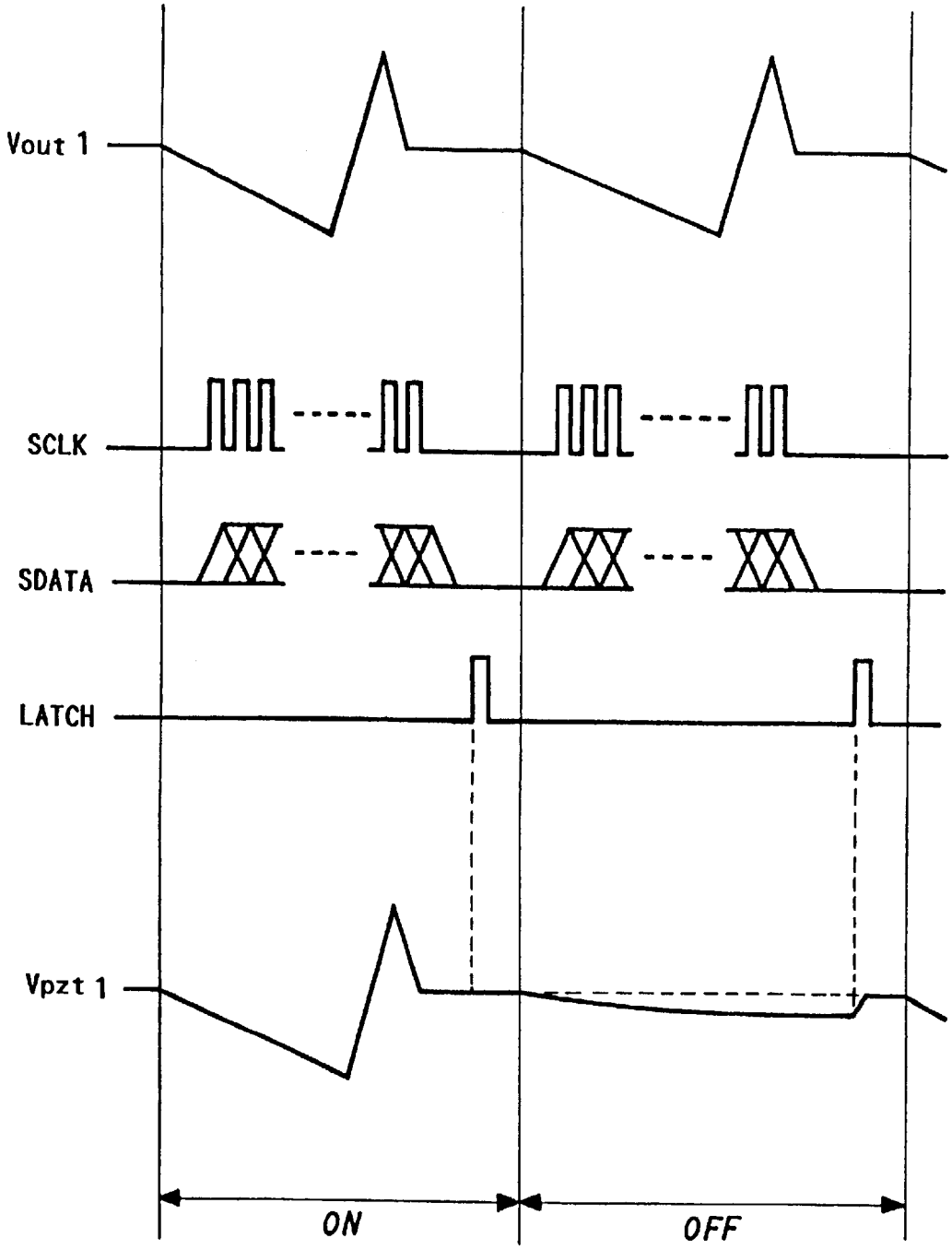
FIG. 7 is a time chart for explaining an effect achieved by the recharging function.

For avoiding this, as shown in FIG. 6, an initializing device in the form of an OR circuit 4 is provided for each of the switches 3*a*, 3*b*, . . . , 3*n*. Each of the initializing devices directly receives latch pulses LATCH for serial print data SDATA and is used for switching a corresponding switching element for VoutI. The latch pulse LATCH is produced every time the print data SDATA is inputted. With this arrangement, as shown in FIG. 7, each of the initializing devices is activated synchronously with the latch pulse LATCH to forcibly turn on the corresponding switching element for Vout1 in the standby state, so that all the piezoelectric elements 2*a*, 2*b*, . . . , 2*n* are recharged to the standby voltage at constant periods. As a result, the foregoing unwanted ink injection can be prevented. This arrangement is particularly effective when the piezoelectric element is deteriorated to lower its insulation resistance.

Third Embodiment

The number of gradation levels per dot can be increased by increasing the number of the drive waveform feed circuits and the number of the switching elements of each of the switches in the circuit structure shown in FIG. 9. However, this complicates the circuit structure and largely increases the cost thereof.

Figure 8:
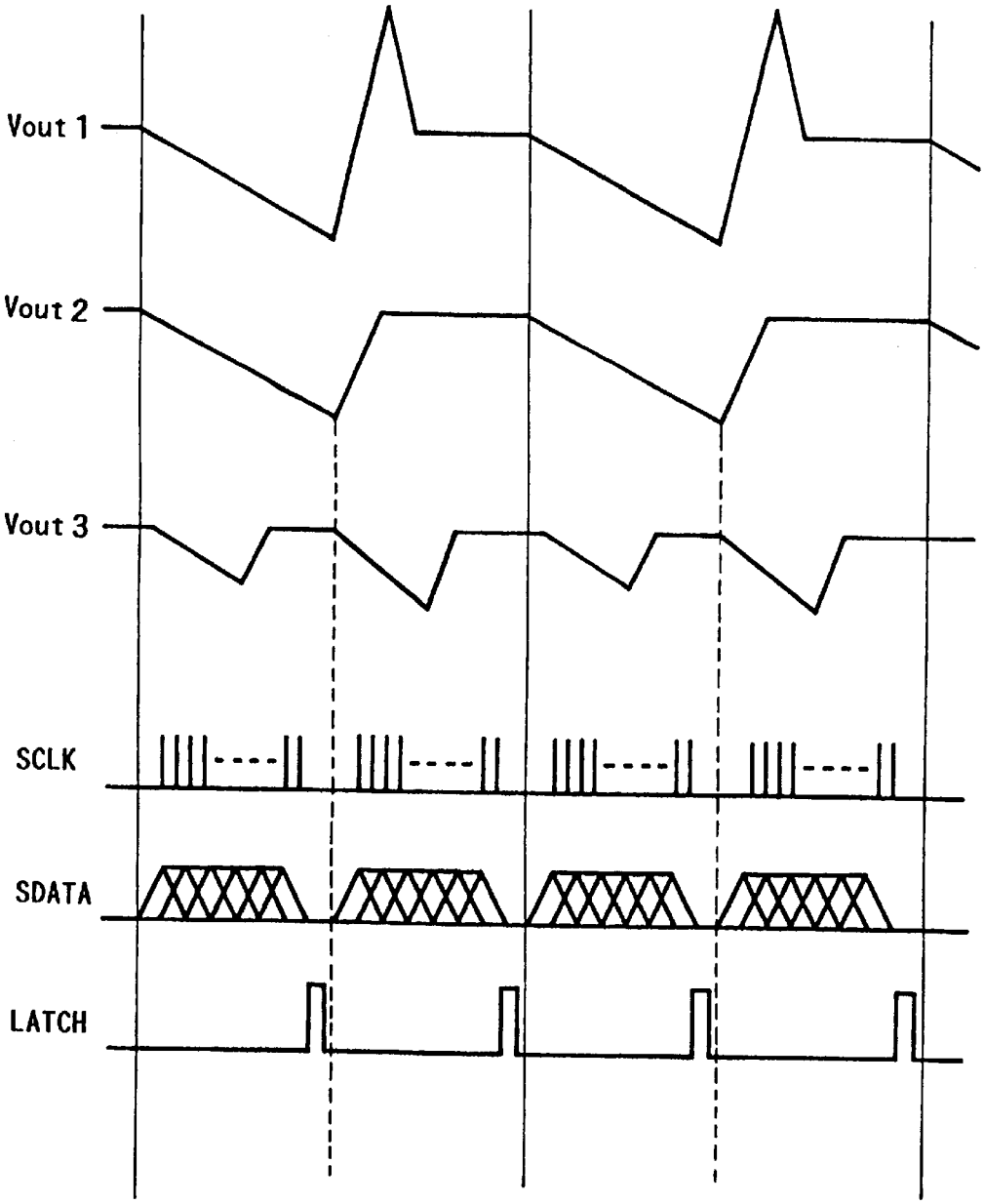
FIG. 8 is a time chart showing a relationship among drive waveforms and control signals, wherein the number of gradation levels per dot is increased.

In view of this, in this embodiment, the number of the gradation levels is increased by providing two kinds of drive waveforms, each capable of an ink injection, in one drive period as shown at (c) in FIG. 2. Specifically, in this embodiment, as shown in FIG. 2, three kinds of drive waveforms are used, that is, for big, middle and small ink drops, and as shown at (c) in FIG. 2, one drive period of the drive waveform for the small ink drop is divided into two sub-periods which have sub-waveforms capable of injecting first and second small ink drops, respectively. As shown in FIG. 9, since three drive waveform feed circuits 1*a*, 1*b*, 1*c* are provided, three kinds of drive waveforms Vout1, Vout2, Vout3 can be selected by the switching device 3. As described above, the drive waveform for the small ink drop is divided into two sub-waveforms for the first and second small ink drops, so that four kinds of the ink drops (big ink drop, middle ink drop, second small ink drop, first small ink drop) can be selected by the switching device 3. FIG. 8 is a time chart showing a relationship among Vout1, Vout2, Vout3 and control signals (SCLK, SDATA, LATCH), wherein Vout3 is divided into sub-waveforms for increasing the number of the gradation levels per dot. As seen from FIG. 8, it is only required that a control firmware be changed to double frequencies of the control signals. Accordingly, it is not necessary to enlarge a scale of the circuit, and thus an increase in cost thereof is not substantial.

By giving weights to amounts of ink drops such that, for example, big drop=5, middle drop=4, second small drop=2, first small drop=1, the switching device 3 can select the first and second small ink drops individually or in combination thereof, or can select only the first or second small ink drop. Specifically, with this arrangement, five gradation levels per dot can be realized in terms of ink drop amounts, i.e. big drop, middle drop, third small drop (combination of first and second small drops), second small drop and first small drop. For matching hit positions of the first and second small ink drops on a print medium to realize the third small ink drop, the first small ink drop whose flying speed is lower (and thus whose injection amount is smaller) than the second small ink drop needs to be injected before an injection of the second small ink drop, that is, a sub-waveform for the first small ink drop is put before that for the second small ink drop in one drive period.

In this embodiment, the drive waveform for the small ink drop is divided into the sub-waveforms. However, the drive waveform/waveforms for the middle and/or big ink drop/drops may be divided into sub-waveforms along with or instead of the drive waveform for the small ink drop.

According to the foregoing first preferred embodiment, by setting at least two changing points in one drive period of at least one of the drive waveforms, or in one drive period of the pressure variation applied to the ink in the pressure chamber, or in one drive period of the internal volume variation of the pressure chamber, the voltage applied to each of the piezoelectric elements in the standby state can be suppressed, so that the stress of the piezoelectric elements against the applied voltage is reduced, that the power consumption is lowered, and that the sufficient amplitude is achieved upon ink injection to ensure the controllability of the ink injection amount.

According to the foregoing second preferred embodiment, each of the piezoelectric elements can be restored to the standby state per given period by simply adding the initializing devices without providing an additional circuit for recharging. Therefore, all the piezoelectric elements can be held within a given voltage range during the standby state, so that the unwanted ink injection can be prevented and the stable ink injection characteristic can be ensured.

In this case, by restoring each of the piezoelectric elements to the standby state synchronously with the latch pulse produced every time the print data is inputted, the voltage can be applied to each piezoelectric element at constant periods without using a particular circuit for initialization.

According to the foregoing third preferred embodiment, a drive period of at least one of the drive waveforms is divided into a plurality of sub-periods in each of which the sub-waveform capable of injecting the ink, the sub-variation of the pressure capable of injecting the ink or the sub-variation of the internal volume of the pressure chamber capable of injecting the ink is provided. Further, one or a plurality of the sub-waveforms, the sub-variations of the pressure or the sub-variations of the internal volume can be selected or set. With this arrangement, the number of the gradation levels can be increased without increasing the drive waveform feed circuits and the corresponding switching elements and thus without complicating the circuit structure.

Further, by setting the foregoing sub-waveforms, sub-variations of the pressure or sub-variations of the internal volume of the pressure chamber to provide mutually different ink injection amounts, the number of the halftone levels can be easily increased.

Further, by setting the foregoing sub-waveforms, sub-variations of the pressure or sub-variations of the internal volume of the pressure chamber in one drive period in order of those which provide lower injection speeds of the ink or which provide smaller injection amounts of the ink, the accuracy of hit positions of the ink drops on the print medium can be improved.

While the present invention has been described in terms of the preferred embodiments, the invention is not to be limited thereto, but can be embodied in various ways without departing from the principle of the invention as defined in the appended claims.

What is claimed is:

1. An inkjet printing device comprising:

a drive waveform feed device for feeding drive waveforms;

deform devices each of which deforms according to applied one of said drive waveforms;

analog switches connected to said deform devices, respectively, for choosing the corresponding deform devices to be fed with the drive waveforms according to print data, each of said analog switches including switching elements each for selecting one of said drive waveforms fed from the drive waveform feed device;

pressure chambers each of which is supplied with ink and injects the ink via a corresponding nozzle by displacing a meniscus of the ink filled therein due to deformation of the corresponding deform device which is caused in response to the selected one of said drive waveforms; and an initializing device provided for each of said analog switches to forcibly turn on one of said switching elements of the corresponding analog switch per given period, so that all the deform devices are restored to a standby state per said given period.

2. The inkjet printing device according to claim 1, wherein each of said analog switches comprises a multi-input-one-output analog switch for selecting one of said drive waveforms.

3. The inkjet printing device according to claim 1, wherein activation of said initializing device is carried out synchronously with latch pulses for the print data.

4. The inkjet printing device according to claim 1, wherein said initializing device restores said deform devices to the standby state by charging them to a given voltage.

5. The inkjet printing device according to claim 1, wherein said initializing device receives latch pulses for the print data so as to forcibly turn on said one of the switching elements of the corresponding analog switch synchronously with the latch pulses.

6. The inkjet printing device according to claim 1, wherein said initializing device comprises an OR circuit provided for each of said analog switches, said OR circuit receiving latch pulses for the print data so as to be activated synchronously therewith to forcibly turn on said one of the switching elements of the corresponding analog switch.

7. An inkjet printing device comprising:

a drive waveform feed device for feeding drive waveforms;

deform devices each of which deforms according to the applied one of said drive waveforms;

analog switches connected to said deform devices, respectively, for choosing the corresponding deform devices to be fed with the drive waveforms according to print data, each of said analog switches including switching elements each for selecting one of said drive waveforms fed from the drive waveform feed device;

pressure chambers each of which is supplied with ink and injects the ink via a corresponding nozzle by varying a pressure applied to the ink filled therein due to deformation of the corresponding deform device which is caused in response to the selected one of said drive waveforms; and an initializing device provided for each of said analog switches to forcibly turn on one of said switching elements of the corresponding analog switch per given period, so that all the deform devices are restored to a standby state per said given period.

8. The inkjet printing device according to claim 7, wherein each of said analog switches comprises a multi-input-one-output analog switch for selecting one of said drive waveforms.

9. The inkjet printing device according to claim 7, wherein activation of said initializing device is carried out synchronously with latch pulses for the print data.

10. The inkjet printing device according to claim 7, wherein said initializing device restores said deform devices to the standby state by charging them to a given voltage.

11. The inkjet printing device according to claim 7, wherein said initializing device receives latch pulses for the print data so as to forcibly turn on said one of the switching elements of the corresponding analog switch synchronously with the latch pulses.

12. The inkjet printing device according to claim 7, wherein said initializing device comprises an OR circuit provided for each of said analog switches, said OR circuit receiving latch pulses for the print data so as to be activated synchronously therewith to forcibly turn on said one of the switching elements of the corresponding analog switch.

13. An inkjet printing device comprising:

a drive waveform feed device for feeding drive waveforms;

deform devices each of which deforms according to applied one of said drive waveforms;

analog switches connected to said deform devices, respectively, for choosing the corresponding deform devices to be fed with the drive waveforms according to print data, each of said analog switches including switching elements each for selecting one of said drive waveforms fed from the drive waveform feed device;

pressure chambers each of which is supplied with ink and injects the ink via a corresponding nozzle by varying an internal volume thereof due to deformation of the corresponding deform device which is caused in response to the selected one of said drive waveforms; and an initializing device provided for each of said analog switches to forcibly turn on one of said switching elements of the corresponding analog switch per given period, so that all the deform devices are restored to a standby state per said given period.

14. The inkjet printing device according to claim 13, wherein each of said analog switches comprises a multi-input-one-output analog switch for selecting one.

15. The inkjet printing device according to claim 13, wherein activation of said initializing device is carried out synchronously with latch pulses for the print data.

16. The inkjet printing device according to claim 13, wherein said initializing device restores said deform devices to the standby state by charging them to a given voltage.

17. The inkjet printing device according to claim 13, wherein said initializing device receives latch pulses for the print data so as to forcibly turn on said one of the switching elements of the corresponding analog switch synchronously with the latch pulses.

18. The inkjet printing device according to claim 13, wherein said initializing device comprises an OR circuit provided for each of said analog switches, said OR circuit receiving latch pulses for the print data so as to be activated synchronously therewith to forcibly turn on said one of the switching elements of the corresponding analog switch.

19. An inkjet printing method wherein deform devices to be fed with drive waveforms are selected using analog switches, each having switching elements each for selecting one of said drive waveforms, according to print data and ink is injected via corresponding nozzles by deforming said deform devices in response to the selected one of the fed drive waveforms to displace meniscuses of the ink in the nozzles, said method comprising the step of forcibly turning on one of the switching elements of the corresponding analog switches per given period so that all the deform devices are restored to a standby state per given period.

20. The inkjet printing method according to claim 19, wherein said deform devices are restored to the standby state synchronously with latch pulses for the print data.

21. The inkjet printing method according to claim 19, wherein said deform devices are restored to the standby state by charging them to a given voltage.

22. The inkjet printing method according to claim 19, further comprising the step of receiving latch pulses for the print data by said initializing device so as to forcibly turn on said one of the switching elements of the corresponding analog switch synchronously with the latch pulses.

23. The inkjet printing method according to claim 19, wherein said initializing device comprises an OR circuit provided for each of said analog switches, and further comprising the step of receiving latch pulses for the print data by said OR circuit so as to be activated synchronously therewith to forcibly turn on said one of the switching elements of the corresponding analog switch.

24. An inkjet printing method wherein deform devices to be fed with drive waveforms are selected using analog switches, each having switching elements each for selecting one of said drive waveformns, according to print data and ink is injected via corresponding nozzles by deforming said deform devices in response to the selected one of the fed drive waveforms to vary pressures applied to the ink filled in corresponding pressure chambers, said method comprising the step of forcibly turning on one of the switching elements of the corresponding analog switches per given period so that all the deform devices are restored to a standby state per given period.

25. The inkjet printing method according to claim 24, wherein said deform devices are restored to the standby state synchronously with latch pulses for the print data.

26. The inkjet printing method according to claim 24, wherein said deform devices are restored to the standby state by charging them to a given voltage.

27. The inkjet printing method according to claim 24, further comprising the step of receiving latch pulses for the print data by said initializing device so as to forcibly turn on said one of the switching elements of the corresponding analog switch synchronously with the latch pulses.

28. The inkjet printing method according to claim 24, wherein said initializing device comprises an OR circuit provided for each of said analog switches, and further comprising the step of receiving latch pulses for the print data by said OR circuit so as to be activated synchronously therewith to forcibly turn on said one of the switching elements of the corresponding analog switch.

29. An inkjet printing method wherein deform devices to be fed with drive waveforms are selected using analog switches, each having switching elements each for selecting one of said drive waveforms, according to print data and ink is injected via corresponding nozzles by deforming said deform devices in response to the selected one of the fed drive waveforms to vary internal volumes of corresponding pressure chambers filled with the ink, said method comprising the step of forcibly turning on one of the switching elements of the corresponding analog switches per given period so that all the deform devices are restored to a standby state per given period.

30. The inkjet printing method according to claim 29, wherein said deform devices are restored to the standby state synchronously with latch pulses for the print data.

31. The inkjet printing method according to claim 29, wherein said deform devices are restored to the standby state by charging them to a given voltage.

32. The inkjet printing method according to claim 29, further comprising the step of receiving latch pulses for the print data by said initializing device so as to forcibly turn on said one of the switching elements of the corresponding analog switch synchronously with the latch pulses.

33. The inkjet printing method according to claim 29, wherein said initializing device comprises an OR circuit provided for each of said analog switches, and further comprising the step of receiving latch pulses for the print data by said OR circuit so as to be activated synchronously therewith to forcibly turn on said one of the switching elements of the corresponding analog switch.

34. An inkjet printing device comprising:

a drive waveform feed device for feeding at least two kinds of drive waveforms;

deform devices each of which deforms according to applied one of said drive waveforms;

a switching device for choosing the deform devices to be fed with the drive waveforms according to print data; and pressure chambers each of which is supplied with ink and injects the ink via a corresponding nozzle by displacing a meniscus of the ink filled therein due to deformation of the corresponding deform device, wherein a drive period of at least one of said drive waveforms is divided into a plurality of sub-periods each having a sub-waveform capable of injecting the ink, and wherein said switching device is capable of choosing one or a plurality of said sub-waveforms, in an order of the sub-waveforms which provide lower injection speeds of the ink.

35. The inkjet device according to claim 34, wherein said sub-waveforms are also set to provide mutually different injection amounts of the ink.

36. The inkjet printing device according to claim 34, wherein said sub-waveforms are also set in order of the sub-waveforms which provide smaller injection amounts of the ink.

37. The inkjet printing device according to claim 34, wherein said sub-waveforms comprise a first sub-waveform for forming a first ink drop on a print medium and a second sub-waveform for forming a second ink drop on a print medium, and wherein said first and second sub-waveforms are so arranged as to form one ink drop on the print medium as a combination of said first and second ink drops when said switching chooses said first and second sub-waveforms within one drive period of the drive waveform.

38. An inkjet device comprising:

a drive waveform feed device for feeding drive waveforms;

deform devices each of which deforms according to applied one of said drive waveforms;

a switching device for choosing the deform devices to fed with the drive waveforms;

a switching device for choosing the deform devices to be fed with the drive waveforms according to print data; and pressure chambers each of which is supplied with ink and injects the ink via a corresponding nozzle by varying a pressure applied to the ink filled therein due to deformation of the corresponding deform device, wherein at least two kinds of pressure variations having different amplitudes are provided and a drive period of at least one of said pressure variations is divided into a plurality of sub-periods each having a sub-variation with an amplitude capable of injecting the ink, and wherein said switching device is capable of setting one or a plurality of said sub-variations, in an order of said sub-variations which provide lower injection speeds of the ink.

39. The inkjet printing device according to claim 38, wherein the amplitudes of said sub-variations are set so as to provide mutually different injection amounts of the ink.

40. The inkjet printing device according to claim 38, wherein said sub-variations are also set in order of the sub-variations which provide smaller injection amounts of the ink.

41. The inkjet printing device according to claim 38, wherein said sub-variations comprise a first sub-variation for forming a first ink drop on a print medium and a second sub-variation for forming a second ink drop on a print medium, and wherein said first and second sub-variations are so arranged as to form one ink drop on the print medium as a combination of said first and second ink drops when said switching chooses said first and second sub-variations within one drive period of the drive waveform.

42. An inkjet printing device comprising:

a drive waveform feed device for feeding drive waveforms;

deform devices each of which deforms according to applied one of said drive waveforms;

a switching device for choosing the deform devices to be fed with the drive waveforms according to print data; and pressure chambers each of which is supplied with ink and injects the ink via a corresponding nozzle by varying an internal volume thereof due to deformation of the corresponding deform device, wherein at least two kinds of internal volume variations having different amplitudes are provided and a drive period of at least one of said internal volume variations is divided into a plurality of sub-periods each having a sub-variation with an amplitude capable of injecting the ink, and wherein said switching device is capable of setting one or a plurality of said sub-variations, in an order of the sub-variations which provide lower injection speeds of the ink.

43. The inkjet printing device according to claim 42, wherein the amplitudes of said sub-variations are set so as to provide mutually different injection amounts of the ink.

44. The inkjet printing device according to claim 42, wherein said sub-variations are also set in order of the sub-variations which provide smaller injection amounts of the ink.

45. The inkjet printing device according to claim 42, wherein said sub-variations comprise a first sub-variation for forming a first ink drop on a print medium and a second sub-variation for forming a second ink drop on a print medium, and wherein said first and second sub-variations are so arranged as to form one ink drop on the print medium as a combination of said first and second ink drops when said switching chooses said first and second sub-variations within one drive period of the drive waveform.

46. An inkjet printing method wherein deform devices to be fed with drive waveforms of at least two kinds are selected according to print data and ink is injected via corresponding nozzles by deforming said deform devices based on the fed drive waveforms to displace meniscuses of the ink in the nozzles, said method comprising the steps of:

dividing a drive period of at least one of said drive waveforms into a plurality of sub-periods each having a sub-waveform capable of injecting the ink;

setting one or a plurality of said sub-waveforms for the corresponding deform devices, in an order of said sub-waveforms which provide lower injection speeds of the ink.

47. The inkjet printing device according to claim 46, wherein said sub-variations are also set to provide mutually different injection amounts of the ink.

48. The inkjet printing device according to claim 46, wherein said sub-variations are also set in order of the sub-waveforms which provide smaller injection amounts of the ink.

49. The inkjet printing method according to claim 46, wherein said sub-waveforms comprise a first sub-waveform for forming a first ink drop on a print medium and a second sub-waveform for forming a second ink drop on a print medium, and wherein said first and second sub-waveforms are so arranged as to form one ink drop on the print medium as a combination of said first and second ink drops when said switching chooses said first and second sub-waveforms within one drive period of the drive waveform.

50. An inkjet printing method wherein deform devices to be fed with drive waveforms are selected according to print data and ink is injected via corresponding nozzles by deforming said deform devices based on the fed drive waveforms to vary pressures applied to the ink filled in corresponding pressure chambers, said method comprising the steps of:

providing at least two kinds of pressure variations having different amplitudes;

dividing a drive period of at least one of said pressure variations into a plurality of sub-periods each having a sub-variation with an amplitude capable of injecting the ink; and setting one or a plurality of said sub-variations for the corresponding pressure chambers, in an order of said sub-variations which provide lower injection speeds of the ink.

51. The inkjet printing method according to claim 50, wherein the amplitudes of said sub-variations are set so as to provide mutually different injection amounts of the ink.

52. The inkjet printing device according to claim 50, wherein said sub-variations are also set in order of the sub-variations which provide smaller injection amounts of the ink.

53. The inkjet printing method according to claim 50, wherein said sub-variations comprise a first sub-variation for forming a first ink drop on a print medium and a second sub-variation for forming a second ink drop on a print medium, and wherein said first and second sub-variations are so arranged as to form one ink drop on the print medium as a combination of said first and second ink drops when said switching chooses said first and second sub-variations within one drive period of the drive waveform.

54. An inkjet printing method deform devices to be fed with drive waveforms are selected according to print data and ink is injected via corresponding nozzles by deforming said deform devices based on the fed drive waveforms to vary internal volumes of corresponding pressure chambers filled with the ink, said method comprising the steps of:

providing at least two kinds of internal volume variations having different amplitudes;

dividing a drive period of at least one of said internal volume variations into a plurality of sub-periods each having a sub-variation with an amplitude capable of injecting the ink; and setting one or a plurality of said sub-variation for the corresponding pressure chambers, in an order of the sub-variations which provide lower injection speeds of the ink.

55. The inkjet printing method according to claim 54, wherein the amplitudes of said sub-variations are set so as to provide mutually different injection amounts of the ink.

56. The inkjet printing device according to claim 54, wherein said sub-variations are also set in order of the sub-variations which provide smaller injection amounts of the ink.

57. The inkjet printing method according to claim 54, wherein said sub-variations comprise a first sub-variation for forming a first ink drop on a print medium and a second sub-variation for forming a second ink drop on a print medium, and wherein said first and second sub-variations are so arranged as to form one ink drop on the print medium as a combination of said first and second ink drops when said switching chooses said first and second sub-variations within one drive period of the drive waveform.

* * * * *